US007956548B2

(12) United States Patent
Zhang

(10) Patent No.: US 7,956,548 B2
(45) Date of Patent: Jun. 7, 2011

(54) ELECTRONIC BALLAST PROTECTION

(76) Inventor: Kanghong Zhang, Torrance, CA (US)

( * ) Notice: Subject to any disclaimer, the term of this patent is extended or adjusted under 35 U.S.C. 154(b) by 283 days.

(21) Appl. No.: 12/384,722

(22) Filed: Apr. 8, 2009

(65) Prior Publication Data

US 2010/0259173 A1 Oct. 14, 2010

(51) Int. Cl.
*H05B 37/02* (2006.01)

(52) U.S. Cl. ..... 315/219; 315/224; 315/276; 315/307

(58) Field of Classification Search ..... 315/219, 315/291, 307, 308, 224, 220, 221, 223, 276, 315/277, 278, DIG. 5, DIG. 7
See application file for complete search history.

(56) References Cited

U.S. PATENT DOCUMENTS

2004/0222752 A1* 11/2004 Yamanaka et al. ..... 315/291
2008/0278088 A1* 11/2008 Yu et al. ..... 315/225
* cited by examiner

*Primary Examiner* — David Hung Vu
(74) *Attorney, Agent, or Firm* — Clement Cheng

(57) ABSTRACT

An electronic ballast powers at least one fluorescent tube or lamp which has a power source; a DC power supply having an input connected to the power source; an oscillator connected to an output of said DC power supply so as to be driven therefrom; a driver means; and a protection means that deactivates the oscillator when the output reaches a predetermined abnormally high voltage. The protection means includes a transformer; a plurality of windings disposed on the transformer, a delegated winding disposed on the transformer. The protection means includes a sample point for sampling voltage. The protection means deactivates the delegated winding disposed on the transformer for the magnetizing the transformer and stopping oscillation when the sample point reaches a predetermined abnormally high voltage.

6 Claims, 3 Drawing Sheets

Protection Circuitry with 4 windings on T1

T1: with 4 windings

Protection Circuitry with 4 windings on T1

T1: with 4 windings

Protection Circuitry with 3 windings on T1

ELECTRONIC BALLAST PROTECTION

DISCUSSION OF RELATED ART

The problem of electronic ballast needing to be shut down has been addressed in the prior art. For example, in U.S. Pat. No. 5,744,912 to So, issued Apr. 28, 1998 entitled Electronic Ballast Having An Oscillator Shutdown Circuit For Single Or Multiple Fluorescent Tubes For Lamps provides for a relay which disables the ballast by shutting down the power supply. The abstract of So discloses generally, "An electronic ballast having particular application for driving small diameter fluorescent tubes or lamps (such as the T2, T4 and T5 sizes). The electronic ballast has a shutdown circuit by which to remove power to the oscillator when the tube or lamp is close to the end of its useful life or when an abnormal condition occurs such that a rise in operating voltage is detected. The shutdown circuit detects the rise in the operating voltage of the tube or lamp and energizes a relay through the conduction path of a photoresponsive transistor that is rendered conducting by a light emitting diode. The relay directs power away from the oscillator and towards the control electrode of the photoresponsive transistor to hold the phototransistor on and thereby disable the ballast. The ballast also includes a power factor controller to provide a high power factor and a more efficient operation." The So patent is hereby incorporated by reference. Besides the method described in the So patent, there are probably a wide variety of other methods for shutting down a ballast oscillator when a tube or lamp is nearing the end of its life.

SUMMARY OF THE INVENTION

The present invention uses the method of deactivating transformer winding which would demagnetize the transformer to stop oscillation and shut down the circuitry without shutting down the entire ballast.

1 EMI Means
2 Rectifier Means
3 Driver Means
4 Output Means
5 Protection Means
6 Switching Means
7 Starting Means

DETAILED DESCRIPTION OF THE PREFERRED EMBODIMENT

Figure 1:
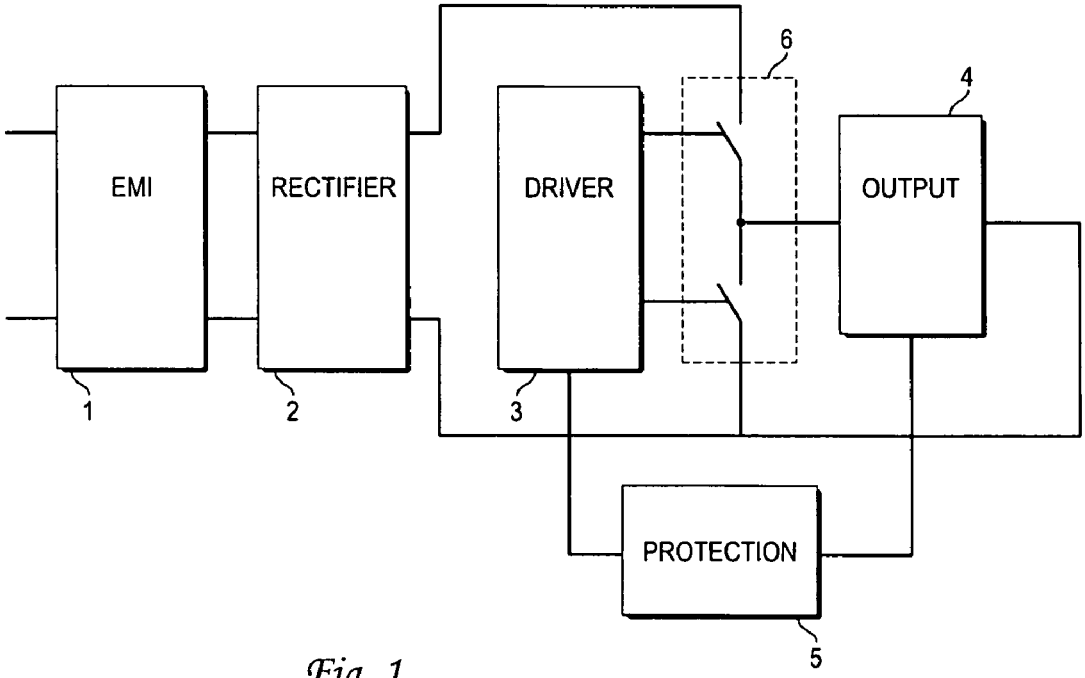
FIG. 1 is a simplified block diagram of the present invention.
Figure 2:
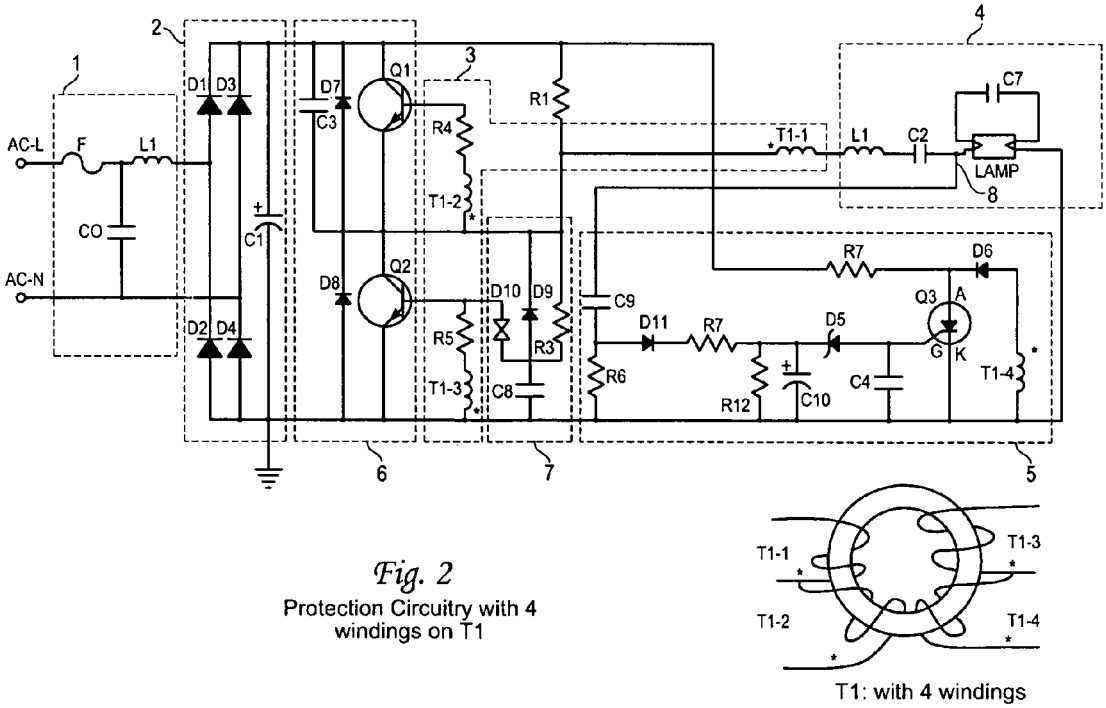
FIG. 2 shows protection circuitry with four windings on T1.

FIG. 1 shows a generalized block diagram of the present invention with an EMI means 1, a rectifier means 2, a driver means 3, an output means 4, a protection means 5 and a switching means 6. The circuitry in FIG. 2 shows EMI means 1, a rectifier means 2, a driver means 3, an output means 4, a protection means 5 and a switching means 6 all in more detail so as to provide a circuit diagram of the present invention. The circuitry in FIG. 2 uses a total of four windings on transformer T1. The first winding T1-1 is in the driver means 3. The second winding T1-2 is also in the driver means 3. The third winding T1-3 is also in the driver means 3. The fourth winding T1-4 is in the protection means 5. The protection means 5 samples the voltage at sample point 8. When the lamp is deactivated or reaches end of life, there would be a high voltage on sample point 8. This voltage is sampled through C9 and R6, then rectified by D11. The rectified voltage charges C10 to a voltage that passes the threshold of zener diode D5 and triggers Q3. R7 will keep Q3 in the on state. T1-4 will get shortened through D5 and Q3 and de-magnetize the transformer. The oscillation will stop and circuitry goes to shutdown mode. T1-4 is the winding which is delegated for de-magnetization which is shut off when the lamp is deactivated or reaches end-of-life. The delegated winding is a winding that is shut off for deactivating oscillation.

Figure 3:
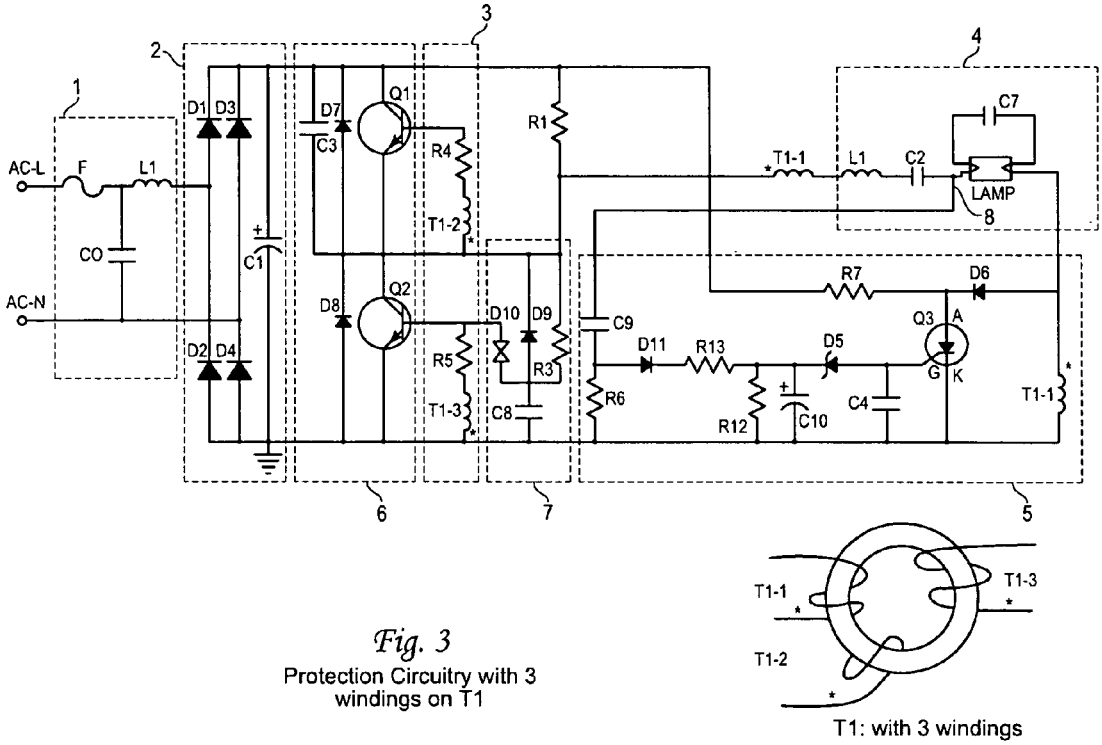
FIG. 3 shows protection circuitry with three windings on T1.

As an alternate embodiment, shown in FIG. 3, the present invention also has the EMI means 1, a rectifier means 2, a driver means 3, an output means 4, a protection means 5 and a switching means 6, again all in more detail so as to provide a circuit diagram of the present invention.

The circuitry in FIG. 3 uses 3 winding on transformer T1. T1-1 is also the winding for de-magnetization. The circuitry in FIG. 3 uses a total of three windings on transformer T1. The first winding T1-1 is in the driver means 3. The second winding T1-2 is also in the driver means 3. The third winding T1-3 is in the protection means 5. The delegated winding in the second embodiment is third winding T1-3, a winding that is shut off for deactivating oscillation.

When the lamp is deactivated or reaches end of life, there would be a high voltage on sample point 8 by the lamp. This voltage is sampled through C9 and R6, then rectified by D11. The rectified voltage charges C10 to voltage that passes the threshold of zener diode D5 and triggers Q3. R7 will keep Q3 in the on state. T1-1 will get shortened through D5 and Q3 and de-magnetizing the transformer. The oscillation will stop and circuitry goes to shutdown mode. FIG. 2 shows starting means 7 which is a circuit for initiating oscillation. The starting means can be used for restarting oscillation after lamp replacement.

Thus, the protection circuitry stops oscillation by demagnetizing a winding of the transformer when there is abnormal voltage to the lamp. The protection means thus deactivates the oscillation means when the output means outputs an abnormally high voltage.

The invention claimed is:

1. An electronic ballast for powering at least one fluorescent tube or lamp comprising:

a. a power source;
b. a DC power supply having an input connected to the power source;
c. an oscillator connected to an output of said DC power supply so as to be driven therefrom;
d. a driver means;
e. a protection means that deactivates the oscillator when the output reaches a predetermined abnormally high voltage, wherein the protection means comprises:
   i. a transformer;
   ii. a plurality of windings disposed on the transformer,
   iii. a delegated winding disposed on the transformer,
   iv. wherein the protection means includes a sample point for sampling voltage, wherein the protection means deactivates the delegated winding disposed on the transformer for the magnetizing the transformer and stopping oscillation when the sample point reaches a predetermined abnormally high voltage.

2. The electronic ballast of claim 1, wherein, the plurality of windings disposed on the transformer is three or more.

3. The electronic ballast of claim 1, wherein, the plurality of windings disposed on the transformer is four or more.

4. An electronic ballast for powering at least one fluorescent tube or lamp comprising:

a. a power source;

b. a DC power supply having an input connected to the power source;

c. an oscillator connected to an output of said DC power supply so as to be driven therefrom;

d. a protection means;

e. a protection circuit that deactivates the oscillator when the output reaches a predetermined abnormally high voltage, wherein the protection means comprises:

i. a transformer;

ii. a plurality of windings disposed on the transformer, iii. a delegated winding disposed on the transformer, iv. wherein the protection means includes a sample point for sampling voltage, wherein the protection means deactivates the delegated winding disposed on the transformer for the magnetizing the transformer and stopping oscillation when the sample point reaches a predetermined abnormally high voltage.

5. The electronic ballast of claim 4, further comprising:

a. three windings on transformer T1 that comprise a first winding T1-1 in the driver, a second winding T1-2 also in the driver, and a delegated winding in the protection circuit; and b. a sample point sampling high voltage through C9 and R6, then rectified by D11 so that the rectified voltage charges C10 to a voltage that passes the threshold of zener diode D5 to trigger Q3 so that R7 will keep Q3 in the on state.

6. The electronic ballast of claim 4, further comprising:

a. an additional winding on transformer T1 comprising a third winding T1-3 in the driver;

b. wherein there are a total of at least four windings on transformer T1.

* * * * *